United States Patent [19]

Parks

[11] Patent Number: 4,595,296

[45] Date of Patent: Jun. 17, 1986

[54] METHOD AND APPARATUS FOR GAS INDUCED MIXING AND BLENDING

[76] Inventor: Richard E. Parks, 9207 NE. 24th, Bellevue, Wash. 98004

[21] Appl. No.: 709,315

[22] PCT Filed: Feb. 6, 1985

[86] PCT No.: PCT/US85/00181

§ 371 Date: Feb. 6, 1985

§ 102(e) Date: Feb. 6, 1985

[87] PCT Pub. No.: WO85/03458

PCT Pub. Date: Aug. 15, 1985

Related U.S. Application Data

[63] Continuation of Ser. No. 577,276, Feb. 6, 1984, abandoned.

[51] Int. Cl.[4] ..... B01F 13/02

[52] U.S. Cl. ..... 366/106

[58] Field of Search ..... 261/77, 123; 366/101, 366/106, 107

[56] References Cited

U.S. PATENT DOCUMENTS

| | | | |
|---|---|---|---|
| 3,179,379 | 4/1965 | Grün . | |
| 3,592,450 | 7/1971 | Rippon . | |
| 4,136,970 | 1/1979 | Cabera et al. | 366/107 |
| 4,168,913 | 9/1979 | Kono . | |
| 4,293,506 | 10/1981 | Lipert . | |
| 4,335,649 | 6/1982 | Velasco, Jr. et al. | 366/107 |
| 4,356,131 | 10/1983 | Lipert | 261/123 |
| 4,374,649 | 2/1983 | Rao | 261/123 |

FOREIGN PATENT DOCUMENTS

| | | | |
|---|---|---|---|
| 0043717 | 7/1981 | European Pat. Off. . | |
| 545047 | 6/1956 | Italy | 366/107 |
| 1400723 | 7/1975 | United Kingdom . | |

OTHER PUBLICATIONS

Transactions of A.S.M.E. Journal of Applied Mechanics, vol. 96, No. 1, Mar. 1974; Mercier et al.: "Influence of Enveloping Water Layer on the Rise of Air Bubbles in Newtonian Fluids", pp. 29–34.

*Primary Examiner*—Robert W. Jenkins
*Attorney, Agent, or Firm*—George M. Cole

[57] ABSTRACT

The invention relates to a mixing and blending system in which pulsed air or gas bubbles (45,46,47) of predetermined variable size and frequency are injected into a tank (10,60,80) containing materials to be agitated or stirred for mixing and blending. The air introduced at the bottom of the tank through an air inlet opening (24, 25). There may be more than one air inlet and the inlets may be provided with accumulator plates (42) depending upon diameter and height of the tank in which the mixing and blending is taking place. The inlets are located so as to create circular toroidal flow (48, 50, 52, 54) of fluid in a generally vertical plane. The accumulator plate has the purpose of assisting the formation of essentially a single bubble (46) from the compressed air charge made to the air inlet and increasing the time required for the bubble to rise through the liquid by causing it to be formed more quickly and closer to the bottom of the tank. Hence, the accumulator plate (42) is utilized in low viscosity liquids such as water.

14 Claims, 11 Drawing Figures

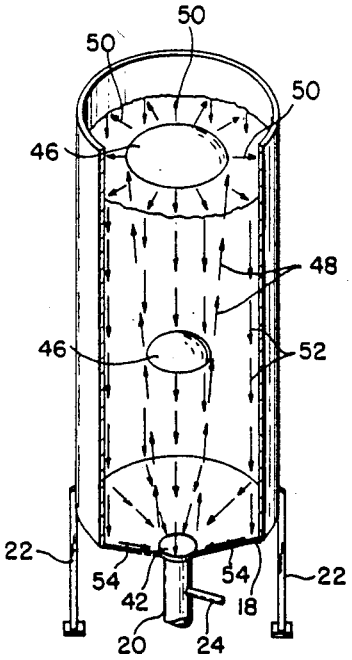
FIG. 3
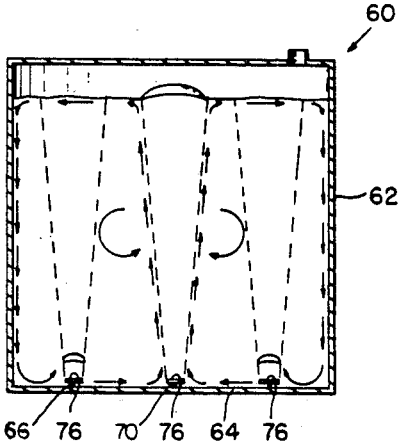
FIG. 4
FIG. 5
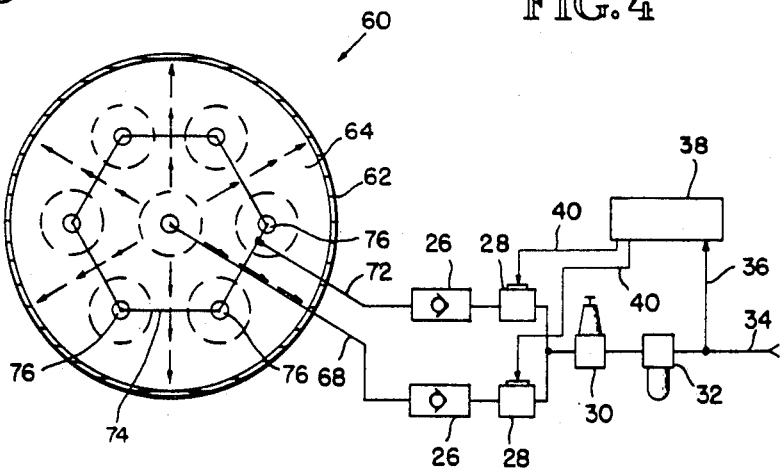

FIG. 6
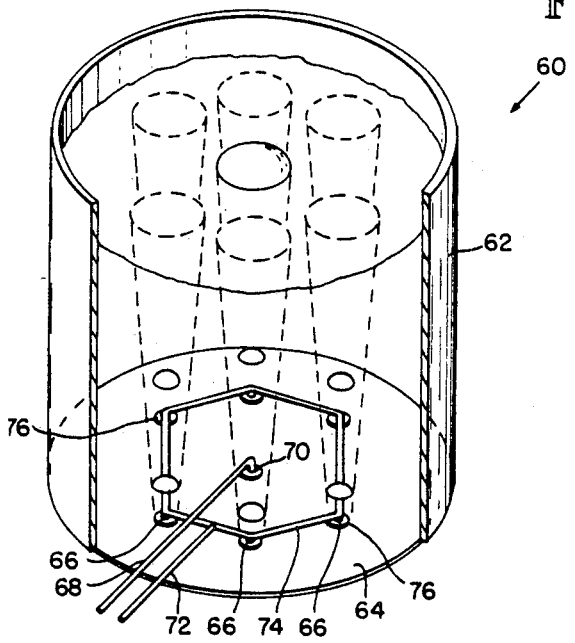
FIG. 7
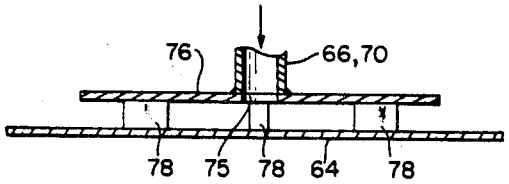
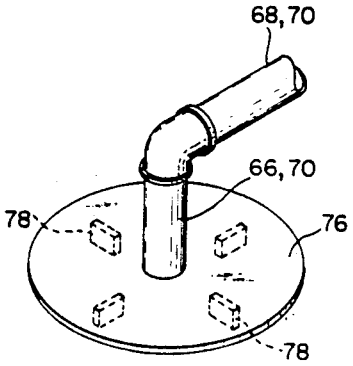
FIG. 8

FIG. 9
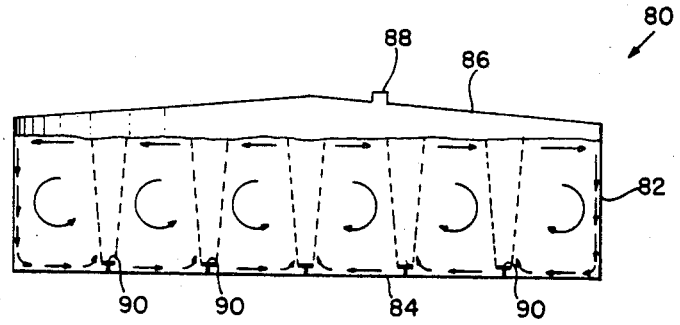
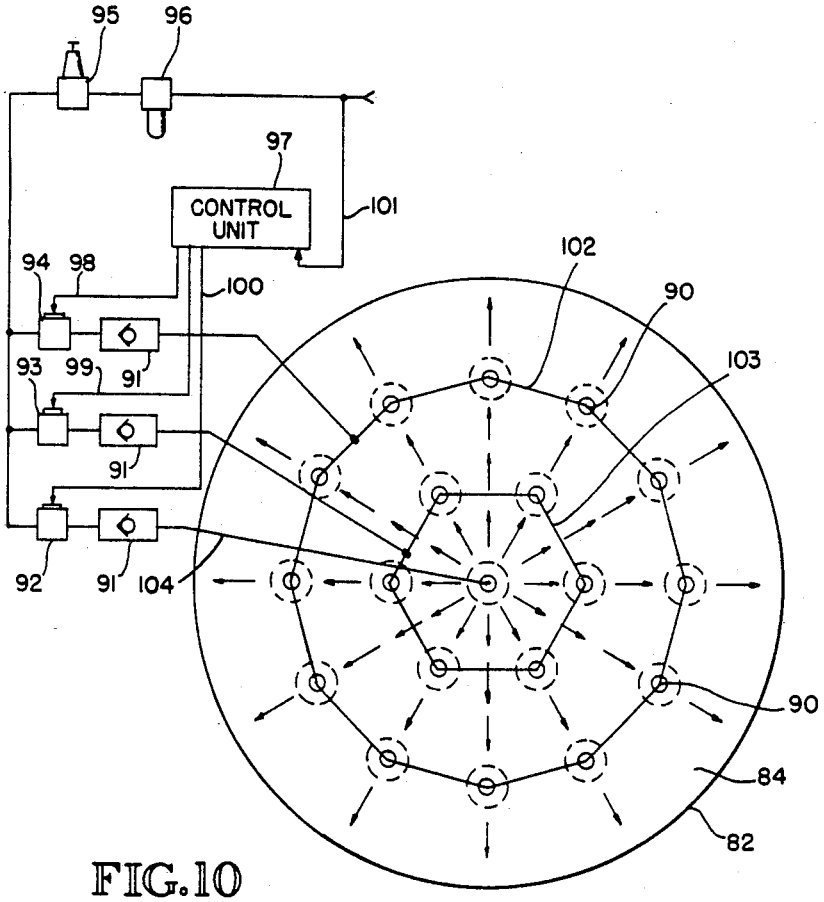
FIG. 10

METHOD AND APPARATUS FOR GAS INDUCED MIXING AND BLENDING

This application is a continuation of my pending U.S. patent application Ser. No. 577,276 filed Feb. 6, 1984, now abandoned.

TECHNICAL FIELD

The invention relates generally to the area of mixing and blending and more particularly to the use of compressed air as an agitating, stirring or mixing medium.

BACKGROUND ART

The use of gas bubbles for mixing the contents of a tank or other container is well known. For instance, blending lubricating oils with additives is done in a large tank in which compressed air is released into the tank at the bottom through a mechanical device called a "spider". It is an apparatus made of crossed pipes with holes in them which allows small bubbles to leave the pipe at the bottom of the tank and rise to the top. Spiders do cause a blending of the material or product in the tank but the blending action is slow and not always complete throughout the container or tank.

Other means for mixing or blending would be mechanical mixtures such as paddles, beaters and, of course, pumping. Mechanical mixers and pumps require routine maintenance and those mechanical mixers which are available may require additional external tank reinforcement to support the drive mechanism as well as the internal components which provide agitation. The air spiders for the most part are maintenance free and have minumum in-tank hardware but are not particularly efficient. The blending time required can vary from a few hours to several days depending on the nature of the liquids being blended. A continuous stream of air produces small bubbles and results in large amounts of entrained air. It will be appreciated that a constant flow of air through an air spider also results in a high consumption of compressed air and thus energy. Mechanical blenders or mixers are also recognized for their high energy requirements.

The only pertinent references known are U.S. Pat. Nos. 3,179,379; 4,136,970; and 4,168,913. The patents cited show either continuous or intermittent air injection at the bottom of a tank. None of the references, however, shows details of the claimed combination of structural elements and method steps as set forth in the instant invention.

Cabrera, U.S. Pat. No. 4,136,970 does not concern itself with regulated air pressure, with spherical shape of the bubbles, or with injecting bubbles in the timing sequence of the instant invention.

Italian Patent No. 545,047 to Klinger is likewise not pertinent since it is concerned only with blending and mixing dry particulates such as cement and lime. Neither in structure nor in operating principal is it pertinent to the invention of this application.

DISCLOSURE OF THE INVENTION

The blending and mixing method and apparatus of this invention is used for open or vented tanks. The relationship of tank diameter and height will determine whether one or more gas/air injection openings are required. A single injection inlet will be located at the center of the tank. Additional inlets will be disposed in one or more circular patterns concentric with the circumference of the tank. The inlets will inject the air in pulses directly into the liquid depending upon the nature of the liquid to form a bubble. In viscous liquids the bubble in the shape of a spherical segment will be formed as it rises. Injection is such that essentially a single bubble is formed. Alternatively over each injection opening is an accumulator plate which effectuates the formation of essentially a single bubble directly over the plate before it rises to the top of the medium being blended. A controller injects the air into the tank from a compressed air supply with a predetermined variable frequency and quantity of air. The pulsed air injections set up generally circular toroidal flow patterns in a vertical plane. Preferably, air actuated circuitry may be used rather than electrical controller circuitry.

Accordingly, it is among the features of the invention that it is simple yet uniquely effective in blending and mixing materials of all kinds. The system reduces overall blending and mixing time and also reduces the amount of entrained air or gases when the instant system is used in place of the old spider system. Because it injects a large volume of air or gas in a short period of time into the tank, there is an increased efficiency. The fact that the system forms a large single bubble and thus reduces the amount of compressed air necessary in order to effectively mix and blend, the energy consumption is therefore also reduced. Since the blending time is reduced due to the increased efficiency, the production capability of an existing mixing or blending tank is substantially increased. The invention is low in cost, simple and convenient to install. The system has a wide range of control over the size and frequency of the bubbles. There are virtually no moving mechanical parts since all aspects of the invention, including the controller, are air operated and thus the invention is essentially maintenance free. The controller is air actuated although electronic circuitry may be used if desired. The system may be used to inject gases as well as air into a particular blending operation. The system is effective in tall, narrow diameter tanks as well as in tanks having a large diameter to height ratio and size of the tanks may vary from a little as a few gallons to many thousands of gallons. The system is equally efficient in cone bottom tanks as well as in flat bottom tanks. The system can be used in liquids which are highly corrosive since stainless steel or other material such as plastic may be employed in the tank and piping. The invention by incorporation of an air-actuated control system may be used safely in highly volatile and hazardous environments and operating conditions. The invention can be used in a number of industrial and commercial applications such as chemical blending, food or beverage processing, sewage treatment, oil well drilling mud, tank trucks and railroad tank cars, tank cleaning, oil storage and blending and others. The invention reduces air entrainment, significantly. The invention creates circular toroidal flow or current patterns in generally vertical planes within the tank which can be particularly important when products of different viscosities and specific gravities are being mixed. This system will inject almost any medium which can pass through a valve, including inert gases, liquids, and fine uniform solids. Once the correct timing of the injection is established, the controller will accurately maintain sequential operation for mixing, agitating and blending.

BRIEF DESCRIPTION OF THE DRAWINGS

FIG. 3 is a cut-away view in perspective showing the circulatory pattern induced by installation of the system in the tank of FIG. 1;

FIG. 4 is a diagrammatic view of the system as it would be used in a flat bottom tank;

FIG. 5 is a plan diagrammatic view of the tank of FIG. 4 showing additional details of the installation of the system in a flat bottom tank;

FIG. 6 shows in perspective additional details of the tank of FIGS. 4 and 5;

FIG. 7 is a partial cross-section view showing that air may be introduced from a pipe coming in over the top of the plate but opening onto the bottom surface of the accumulator plate;

FIG. 8 shows a perspective view of an accumulator plate as it would be spaced from the bottom of a tank;

FIG. 9 shows that one or more rings of inlets and accumulator plates may be necessary in a large tank in which diameter was great in comparison to height; and FIG. 10 is a plan view of the tank in FIG. 9 indicating the circulatory pattern of the materials within the tank.

BEST MODE FOR CARRYING OUT THE INVENTION

The invention comprises injecting a predetermined quantity of compressed air or gas into a liquid medium at a specified but variable frequency in order to generate substantially a single bubble which may be roughly described as a hemispherical or a spherical segment shape. The pressured air or gas injected is introduced into the tank in a fraction of a second though injection time and air pressure will depend upon liquid characteristics such as viscosity. The size of the bubble or quantity of air is an emperical determination. For instance in blending oil stocks the bubble should not be so large that when it breaks the surfaces it splatters or splashes oil out of the tank. As accurately as can be determined, the volume of the spherical segment bubbles begins at about 1 cubic inch as a minimum to much larger which can in a large tank containing viscous materials range up to several cubic feet in volume.

The air injection of a discrete or finite quantity of relatively high presure air in a short period of time, i.e. less than a second, results in the formation of a bubble which is hemispherical on its upper surface but somewhat flat or even concave across its lower surface, thus presenting the shape or configuration of a spherical segment. The spherical segment shape displaces a considerably greater circular area in the liquid than would a round or spherical bubble of the same volume. Again, it has been determined that the bubbles are in volume about 1 cubic inch and more. The cross-sectional area across the largest part of the spherical segment bubble is on the order of 4 to 6 times the cross-sectional area of a round bubble of the same volume. Thus, as it moves upwardly and expands the spherical segment bubble because of its horizontal area displacement acts much more efficiently in generating currents and movement within the tank contents, as shown diagrammatically in the various drawing figures.

Absent an accumulator plate the bubble is formed from about $\frac{1}{4}$ to $\frac{1}{2}$ the depth of the liquid head measuring from the bottom of the tank to the liquid surface. In low viscosity liquids, however, such as water, a single bubble may not be formed unless the accumulator plate is provided. Frequency of the bubbles is generally determined by the interval of time required for a bubble to rise to the surface before the next pulse or shot of air is injected. For pulses in the forms of tanks in FIGS. 4 through 10 the controller will allow air to be sequentially injected into the rings of injectors. Thus, after air is introduced to the center inlet 70, air will then be released to concentrically disposed inlets 76 at a time interval assisting in maintaining the current flow.

Figure 1:
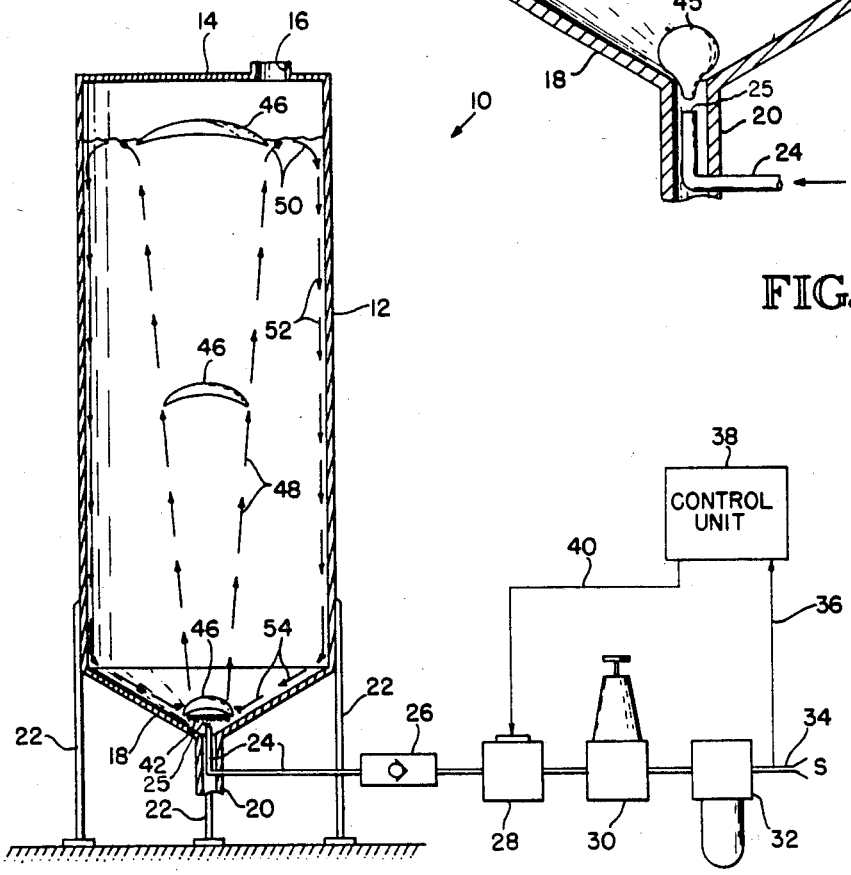
FIG. 1 is a diagrammatic view of an installation utilizing a single injection opening under an accumulator plate and further showing details of an installation.
Figure 2A:
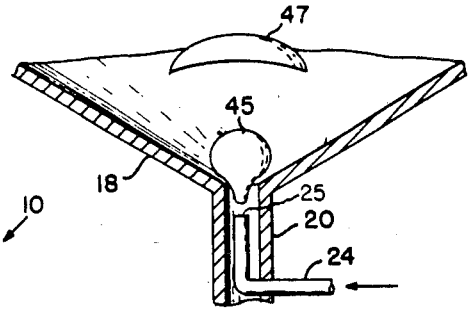
FIG. 2A shows an air injection opening without an accumulator plate.
Figure 2:
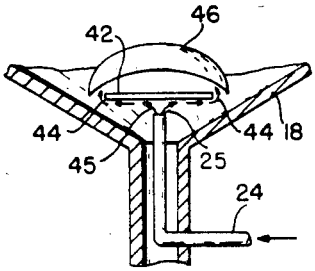
FIG. 2 is a partial cross-sectional view of the bottom of a cone-type tank showing diagrammatically the position of an accumulator plate over the air inlet opening and formation of a bubble.

Referring now to the drawings, and more particularly FIGS. 1 to 3, it will be seen that the cone or V-bottom tank 10 has cylindrical wall 12, top or cover 14, and a vent opening 16. At its bottom, the tank has the inwardly and downwardly angling or cone bottom 18 with outlet 20. Support legs 22 are provided for maintaining the tank in its upright position. An air inlet line 24 is provided for admitting air to the bottom of the tank. FIG. 2A shows diagrammatically a predetermined quantity air injection 45 and its formation into spherical segment bubble 47. Bubble 47 will be formed from about $\frac{1}{4}$ to $\frac{1}{2}$ the distance from the bottom of the tank to the surface of the liquid in viscous liquids.

The control components include check valve 26, air inlet valve 28, pressure regulator 30, filter 32 and incoming supply line 34 for the compressed air. In an air actuated control unit air will be taken off the compressed air supply and directed to the controller as indicated by line 36 to controller 38 which in turn via line 40 controls the air inlet valve 28. The controller may be electrically or electronically operated, if desired.

Spaced slightly above the opening 25 of the inlet line 24 is an accumulator plate 42 which may be a quarter to one-half inch above opening 25 and which is of a predetermined diameter in relation to the diameter of the tank itself. The accumulator plate 42 need not have any specific thickness but is most desirably round and from about 1/10 to 1/20 the diameter of the tank. The preferred accumulator plate diameter is approximately 1/16 the diameter of the tank. Thus, a six foot diameter mixing tank will incorporate an accumulator plate or plates of slightly over seven inches diameter. While supports are not shown, it will be appreciated that means for supporting plate 42 in place will be spaced about every 90 degrees so that it is horizontal and firmly secured in position.

The periodic injection of air at a predetermined frequency to create a bubble in a tank of liquid is easily observable in a transparent test tank. As the pulsed injection of air is released from the opening it follows the path of arrows 44 and 45 out of the opening and along the underside of plate 42 and around the edges of the plate to form bubble 46. If injected without a plate the air still forms essentially s single bubble but higher up in the tank. When directed against the underside of the accumulator plate 42, the predetermined quantity of air also forms essentially one large single bubble. With or without the plate, bubble size is regulated by the time valve 28 which is opened and closed by the controller, by inlet pipe size and air line pressure. It has been determined that the bubbles generated for this method, regardless of size of tank, whether as small as twenty-five or fifty gallons or whether many thousands of gallons in capacity, are from approximately 1 cubic inch in volume and larger to perhaps as large as several cubic feet in volume.

The sudden generation of the bubble in a fraction of a second appears to cause a vibration of the liquid as it is displaced by the air. As the spherical segment bubble rises and expands, it creates currents which enhance the mixing of the contained fluid materials. When the bubble reaches the liquid surface and dissipates, it causes radially outwardly directed currents in the liquid at and near the surface as shown by upwardly directed arrows 48, horizontal arrows 50 and vertically downwardly directed currents of material as indicated by arrows 52. When the currents reach the inner wall of the tank, they flow downwardly along the tank's inner wall to the bottom where they then flow along the bottom surface as indicated by arrows 54 toward the air inlet opening 25. Thus, generally circular, toroidal flow patterns in a generally vertical plane within the tank are generated. This circulation pattern is particularly significance since heavier liquids and/or particles are drawn towards the inlet opening 25 and then lifted towards the top of the tank. This action is the primary result of the periodic pulsing resulting from the controller acting on the compressed air supply. Additionally, a harmonic frequency may be created by the periodic injection frequency of the air into the tank. The toroidal circulatory flow pattern in a generally vertical plane just described is the result of the operation of the control system and location of the inlets. The circulatory pattern is a significance assistance to the blending because of the horizontal bottom currents and the circulatory motion.

When the accumulator plates are employed the bubbles are generated much closer to the bottom of the tank. Forming the bubbles closer to the bottom, especially in flat-bottomed tanks, increases the scouring or liquid currents on the bottom. In this way, dead areas or areas of little mixing action are minimized or avoided. Forming the bubble higher, as without a plate, reduces bottom mixing. The accumulator plates are quite effective when, for instance, liquids of various specific gravities are being blended or when the liquid has light viscosity properties.

FIGS. 4–6 show the arrangement of multiple air inlet openings in a flat bottom tank in which the diameter of the tank is approximately equal to its height. In embodiment 60 tank 62 has flat bottom 64. It will be seen that inlets 66 are provided at approximately 60 degree intervals from each other on a circular concentric line which is approximately half the radius of tank 60. In this particular instance, one inlet line 68 goes to the center inlet 70 while a second inlet line 72 extends to the connector line 74 for each of the inlets 66. It will be appreciated that the accumulator plates 76 are set slightly above the bottom 64 by spacers 78 and that the inlets 66 and 70 open into the underside of the plate through an opening 75 in the plate. The air then flows outwardly from beneath towards the edge so that the bubble can be formed as described above. Air may be injected from below the plates or from above as shown in FIGS. 6 to 8. It is preferred that the spacers or supporting means 78 be located so as not to extend outwardly beyond the edge of the plate and that they be thin so as not to interfere or disrupt the air movement.

The size of the accumulator plates 76 is roughly 1/10 to 1/20 the diameter of the tank itself, again with 1/16 being the preferred ratio. The drawings by use of dotted lines show bubbles rising in an expanding form to generate the circulation patterns, shown by the arrows in FIGS. 4 and 5. The pattern as mentioned above is to set up a current which moves upwardly with the bubbles, flows radially outwardly at the top and downwardly on the inside of the wall, and then moves inwardly across the bottom wall 64. In an asphalt emulsion which is a combination of asphalt, water, asbestos and clay, the tendency is for the heavier particles, or components of the mixture such as the asbestos and clay, to settle out on the bottom. With the circulation pattern established with this system, it was found that even in such a heavy, viscous emulsion the heavier particles will in fact stay in suspension. In the embodiment of FIGS. 4–6, the controller will pulse a predetermined amount of compressed air alternately to the center inlet 70 and then the multiple inlets 66 on connector line 74. Again, the inlets and plates are shown to be on a tank half radius line at 60 degree spacings. Thus, it has been determined that utilizing the instant air system provides a solution to the settling problem particularly in flat bottomed banks by incorporating the accumulator plates.

FIGS. 9 and 10 show a tank with a diameter which is quite large in relation to its height. Shown is tank 80 with side wall 82 and bottom 84 having air inlets under accumulator plates 90 though it will be recognized that the accumulator plates are not mandatory if the nature of the tank contents is such that the bubbles are formed as described. The circulation pattern in the liquid being mixed or blended is illustrated roughly by the arrows. The toroidal circulation pattern or flow is created by the sequential cycling of the three air or gas injection valves 92, 93 and 94. The center injection inlet is actuated by valve 92 followed sequentially by air to the outlets on connector line 103 through valve 93 and finally to the outlets on connector line 102 via valve 94. Sequencing is timed so that when the bubble from the center reaches the surface air is then injected to line 103. When bubbles from line 103 reach the liquid surface valve 94 is actuated to release air to line 102 and the outer circle of inlets. It will be noted that twelve air injectors are shown in FIG. 10 equi-spaced on a circle which is concentric to line 103 and the tank wall. When the bubbles from the outer ring of injectors have reached the surface the cycle begins anew at the center. In this way, the air pulses complement each other and result in a thorough mixing and blending action because of the circular toroidal generally vertical flow patterns in the liquid.

It will be understood that inlet pipe size should be adequate to allow a large volume of air to be injected in a short period of time, most desirably in a fraction of a second. Primary factors in establishing bubble size are head or liquid height, compressed air pressure and time, with time clearly depending upon piping, valving size and air pressure. The spherical segment shape or configuration of the bubbles is produced by injecting the desired quantity of air per bubble in a short period of time, preferably in a fraction of a second.

I claim:

1. A method for air or relatively high pressure induced blending and mixing of liquids and other materials in a container having side and bottom walls, comprising:

(a) locating first compressed air inlet means in close proximity to the bottom of said container at a predetermined location, (b) introducing compressed air or relatively high pressure in predetermined pulsed quantity and frequency to said container through said air inlet opening, each said pulsed quantity of air being introduced to said container at approximately the same point in time the previous pulsed quantity reaches the surface of the materials in said container, (c) forming an air bubble from each pulsed quantity of air introduced through said air inlet opening so that substantially discrete, single bubbles of spherical segment shape are formed, and (d) creating generally circular, vertical toroidal flow patterns within said material such that said material moves upwardly with said bubble and then outwardly in proximity to the surface and then moves downwardly toward the bottom in a continuing, controlled flow pattern for mixing and blending the materials in said container.

2. The method for blending and mixing according to claim 1 and further including locating said at least one air inlet means at the center of said container.

3. The method for blending and mixing according to claim 2 and further disposing a plurality of second compressed air inlet means on a concentric line with respect to said first inlet means, said second compressed air inlet means being of a predetermined number and generally equispaced and further being pulsed with air generally simultaneously and separately after a bubble from said first means.

4. The method for blending and mixing according to claim 3 and further including disposing said concentric line of second inlet means approximately midway between said first inlet means and the side wall of said container.

5. The method for blending and mixing according to claim 4 and further including disposing a plurality of third compressed air inlet means outwardly of and on a concentric line in respect of said first and secod inlet means, said third air inlet means being predetermined in number and generally equispaced and further being pulsed with air substantially simultaneously and separately after pulses to said first and second means.

6. The method of blending and mixing according to claim 1 and further including disposing a flat accumulator plate means generally horizontally and slightly above each said air inlet means such that air from each said air inlet opening is introduced to said container on the underside of said plate so that a bubble from a pulsed quantity of air is formed in close proximity to the bottom of said container.

7. A method for air induced blending and mixing of liquids and other materials in a container having side and bottom walls, comprising:

(a) locating first compressed air inlet means in close proximity to the bottom of said container at the center thereof, (b) introducing compressed air in predetermined pulsed quantity of from a minimum volume of about 1 cubic inch into said container through said air inlet opening, each said pulsed quantity of air being injected into said container in less than a second at approximately a frequency determined by the same moment in time the previous pulsed quantity reaches the surface of the materials in said container, (c) forming an air bubble from each pulsed quantity of air introduced through said air inlet opening such that substantially discrete, single bubbles of spherical segment shape are formed, and (d) creating generally circular, vertical toroidal flow patterns within said material such that said material moves generally upwardly with said bubble and then outwardly in proximity to the surface and then moves downwardly toward the bottom in a continuing, controlled flow pattern for mixing and blending the materials in said container.

8. The method for blending and mixing according to claim 7, and further disposing a plurality of second compressed air inlet means on a concentric line with respect to said first inlet means, said second compressed air inlet means being of a predetermined number and generally equispaced and further being pulsed with air generally simultaneously and separately after a bubble from said first means.

9. The method for blending and mixing according to claim 8 and further including disposing said concentric line of second inlet means approximately midway between said first inlet means and the side wall of said container.

10. The method for blending and mixing according to claim 9 and further including disposing a plurality of third compressed air inlet means outwardly of and on a concentric line in respect of said first and second inlet means, said third air inlet means being predetermined in number and generally equispaced and further being pulsed with air substantially simultaneously and separately after pulses to said first and second means.

11. The method of blending and mixing according to claim 7 and further including disposing a substantially flat accumulator plate means generally horizontally and slightly above each said air inlet means such that air from each said air inlet opening is introduced to said container on the underside of said plate so that a bubble from a pulsed quantity of air is formed in close proximity to the bottom of said container.

12. Apparatus for air induced blending and mixing of liquids and other materials in a container having side and bottom walls, comprising:

(a) at least one air inlet opening in close proximity to the bottom of said container and having a predetermined location therein;

(b) an accumulator plate means generally centered over and horizontally disposed with respect to said at least one air inlet opening so that air is introduced into said container from said at least one inlet opening on the underside of said accumultor plate means, said air being injected into said container from said opening is then directed outwardly toward the periphery of said plate and upwardly around the peripheral edges thereof to effectuate the formulation of a substantially single, discrete air bubble around said plate and which bubble releases from said plate and rises in said fluid medium to induce blending and mixing currents therein; and (c) control means for said air inlet opening including a supply of compressed air connected to said air inlet opening and also valve means for controlling the pulsed introduction of compressed air to said air inlet opening.

13. The apparatus according to claim 12 and wherein said accumulator plate means is generally round having a diameter from about 1/10 to 1/20 of said container.

14. The apparatus according to claim 13 and in which said accumulator plate means has a diameter of about 1/16 the diameter of said container.

* * * * *